United States Patent [19]

Vecchiarelli

[11] Patent Number: 4,722,382

[45] Date of Patent: Feb. 2, 1988

[54] WINDOW BLIND ASSEMBLY

[76] Inventor: Francis Vecchiarelli, 482 Bogert Rd., River Edge, N.J. 07661

[21] Appl. No.: 22,761

[22] Filed: Mar. 6, 1987

Related U.S. Application Data

[62] Division of Ser. No. 829,286, Feb. 13, 1986.

[51] Int. Cl.[4] ..... E06B 9/38

[52] U.S. Cl. ..... 160/178 R; 160/178 B

[58] Field of Search ..... 160/178 R, 168, 178 B, 160/168 R, 172

[56] References Cited

U.S. PATENT DOCUMENTS

| | | | |
|---|---|---|---|
| 2,391,904 | 1/1946 | Junkunc | 160/178 R |
| 2,643,713 | 6/1953 | Mayer | 160/178 R |
| 4,441,540 | 4/1984 | Tsuhoho | 160/178 R X |

*Primary Examiner*—Reinaldo P. Machado
*Assistant Examiner*—Sarah A. Lechok Eley
*Attorney, Agent, or Firm*—Pearne, Gordon, McCoy & Granger

[57] ABSTRACT

Lower end portions of the lift cords of a Venetian blind assembly are retained within the bottom rail of the assembly by a helical tension spring that is normally in an unexpanded or unloaded condition when the bottom rail is moved toward or away from the top rail by manipulating the lift cords. When the bottom rail is held in fixed position relative to the top rail, the lower end portions of the lift cords can be pulled from within the bottom rail to expand the spring so as to apply a user controllable tensioning force on the lift cords which are then locked in position. The now tensioned lift cords serve to maintain and stabilize the position of the ladder and slat structure of the blind assembly where it is mounted in a moving vehicle, for example, or where it is inclined from a vertical plane. The bottom rail also includes a concealed clip and end caps for interconnecting generally identical upper and lower portions of the bottom rail, and a connector for facilitating the connection of the lower ends of the ladder to the bottom rail.

3 Claims, 7 Drawing Figures

WINDOW BLIND ASSEMBLY

This is a division of application Ser. No. 829,286, filed Feb. 13, 1986.

BACKGROUND OF THE INVENTION

The present invention relates in general to window-mounted Venetian blind assemblies, and more particularly to a Venetian blind assembly for use with a window in a moving vehicle, such as a recreational camper or van, or for use with a window inclined from a vertical plane, such as a skylight.

A typical Venetian blind assembly of the type under consideration includes a top rail member fixed in position above an associated window, a collapsible ladder and slat structure suspended from the top rail member, and a movable bottom rail member connected to the lower end of the ladder and slat structure. The bottom rail member can be moved upwardly toward the top rail member by use of two or more lift cords to progressively collapse the ladder and slat structure so as to raise the blind, or the lift cords can be released to allow the bottom rail member to move downwardly by gravity so as to lower the blind.

The ladder and slat structure includes a plurality of horizontally extending parallel slats resting on the crosspieces of two or more vertically extending flexible tapes or ladders, each having a pair of sidepieces, the upper ends of which are connected to the top rail member, the lower ends of the ladder sidepieces being connected to the bottom rail member. A user actuated tilting mechanism located within the top rail member causes the sidepieces of each ladder to simultaneously move in opposite vertical directions wherein the slats can be titled to open or close the blind by a predetermined amount as is well known in the art.

In adapting the above-noted Venetian blind assembly for use in a moving vehicle, or for use with an inclined window, such as a skylight, it becomes necessary, when the blind is in a lowered condition, to releasably lock and hold the bottom rail member in position below the associated window so that it will not swing out away from the associated window.

Even with the bottom rail member fixed in position relative to the top rail member, means should be provided to maintain and stabilize the position of the ladder and slat structure extending between the rail members. If such stabilizing means is not provided, the ladder and slat structure will repeatedly bang against the associated window of a moving vehicle, or it will sag in an unsightly manner when being used with a window inclined from a vertical plane, such as a skylight.

To the present inventor's knowledge, the usual means for providing the required stabilization of the ladder and slat structure as set forth above is to pull down on the bottom rail member when the blind is fully lowered so as to place tension on the ladders, and then lock or fix the bottom rail member in position so as to maintain the tension force on the ladders. Thus, the tensioned ladders limit the movement of the slats thereby stabilizing the ladder and slat structure.

Numerous disadvantages result from the abovenoted stabilization technique. For example, the material forming the ladder can, over a period of time, be stretched, thus requiring that the fixed position of the bottom rail member relative to the top rail member be changed to increase the distance between the rail members to ensure desired tensioning of the ladders. Also, tensioning of the ladders interferes with the smooth operation of the slat tilting mechanism due to frictional binding between the tensioned ladder sidepieces and the slats. Also, the tension forces can cause unsightly arcing or bowing of the bottom rail which is typically not designed to resist forces on it tending to cause such arcing or bowing. Also, it can be seen that the length of the blind must be accurately controlled when it is to be installed on a window frame providing, at a fixed vertical distance apart, the retaining means for fixing in position both of the rail members, i.e. the length of the blind must be slightly shorter than the distance between the top rail member retaining means and the bottom rail member retaining means so as to provide vertical tensioning of the blind when locked in position.

Accordingly, it is a primary purpose of the present invention to provide a Venetian blind assembly which overcomes each of the aforementioned shortcomings without offsetting disadvantages.

SUMMARY OF THE INVENTION

A top rail member, and a bottom rail member spaced in parallel relation from the top rail member, are provided. The bottom rail member is movable toward or away from the top rail member by manipulating two or more lift cords extending between the rail members. A collapsible ladder and slat structure also extends between the rails, and is engagable along its length by the lift cords. Preferably, the lift cords pass through transverse slots in the slats of the ladder and slat structure.

In accordance with the present invention, the bottom rail includes a spring means for retaining within the bottom rail member lower end portions of the lift cords, the spring means being in an unloaded condition when the bottom rail member is moving toward or away from the top rail member. When the bottom rail member is held at a fixed distance from the top rail member, the lower ends of the lift cords can be partially pulled from within the bottom rail member to load the spring means which then applies a tensioning force to the lift cords. The tensioned lift cords thus maintain and stabilize the position of the ladder and slat structure, as opposed to the prior art technique wherein the ladders of the ladder and slat structure were tensioned. Since the ladders are not tensioned to a significant degree, the slats can easily be tiled to open and close the blind. Also, the length of the blind is no longer critical since tensioning of the tapes to any significant degree is not required.

Preferably, the spring means is in the form of a spiral tension spring having one end connected to the lower end of one lift cord, the other end of the spiral tension spring being connected to the lower end of another lift cord, the tension spring being loaded or expanded when the lower end portions of the lift cords are pulled from within the bottom rail member.

In further accordance with the invention, the bottom rail preferably includes a channel-shaped upper half, and a generally identical channel-shaped lower half inverted relative to the top half, the upper and lower halves of the rail being connected together by a spring clip and end caps. Such a bottom rail member is strong enought to resist bowing or arcing forces applied to it by the tensioned lift cords, and is easily assembled as will become apparent from the following detailed description.

In further accordance with the invention, annular connectors located between the bottom rail member halves receive lower end portions of the sidepieces of the ladders, the annular connectors being crimped to retain the sidepiece end portions. Thus, the bottom rail member is supported by the lower end portions of the ladder sidepieces connected together by the annular connectors. Such a technique for connecting the bottom ends of the ladders to the bottom rail member permits accurate control of the length of the ladders between the top and bottom rail members, and also facilitates rapid assembly of the blind.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
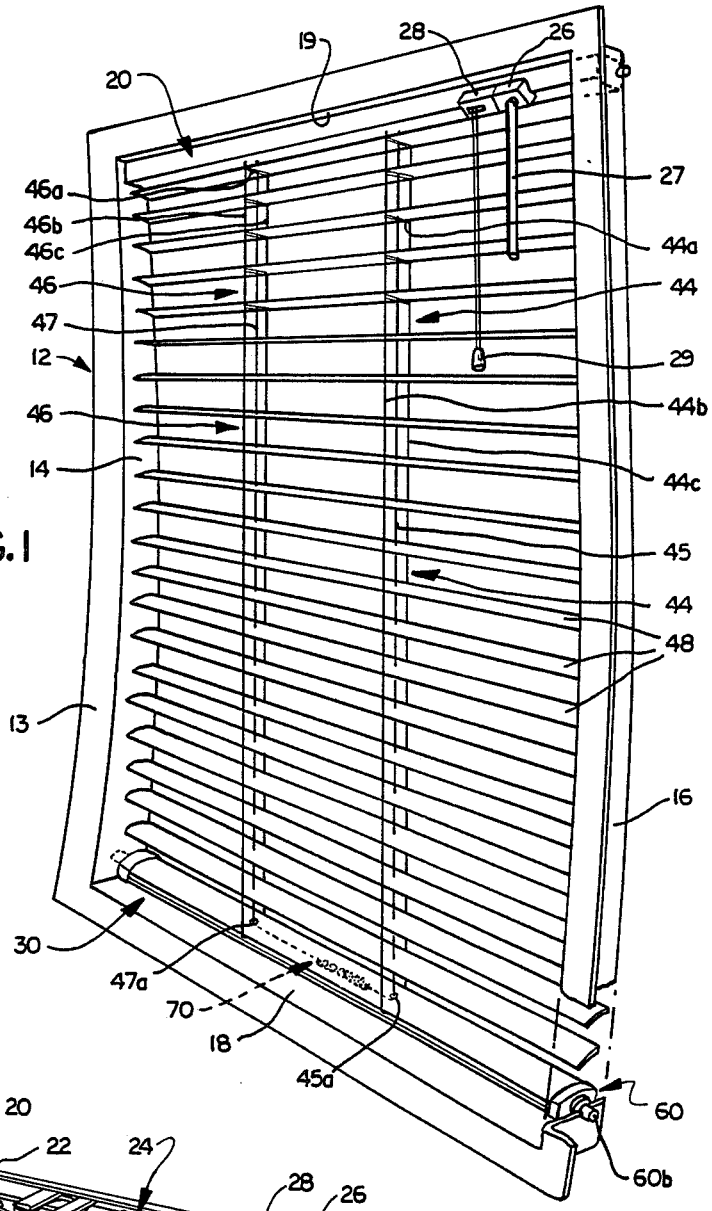
FIG. 1 is a perspective view of a Venetian blind assembly in accordance with the present invention, wherein the blind assembly is mounted to a window frame or shroud, and is in a fully lowered condition.
Figure 2:
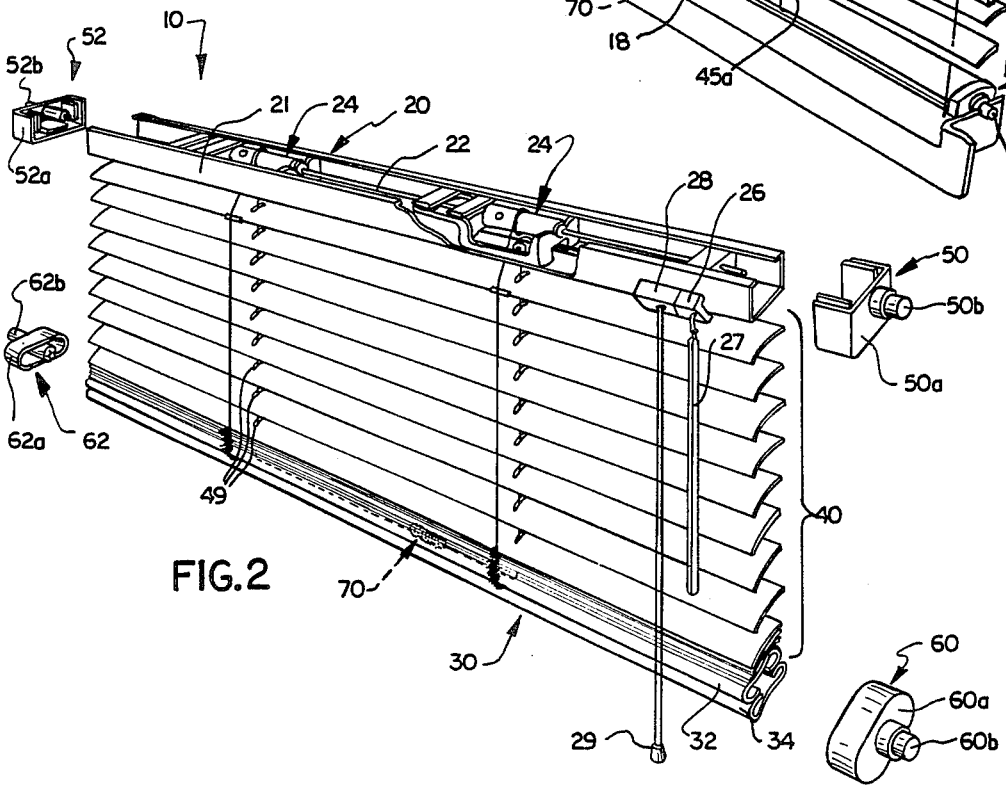
FIG. 2 is a partially exploded perspective view of the blind assembly of FIG. 1 apart from the associated window shroud, wherein the blind assembly is in a partially raised condition.

With reference to FIGS. 1 and 2 of the drawings, a Venetian blind assembly 10 in accordance with the present invention is illustrated. The blind assembly 10 includes an elongated top rail member 20 and an elongated bottom rail member 30 spaced below the top rail member 20 in horizontally parallel relation thereto. A collapsible ladder and slat structure 40 is connected to and suspended from the top rail member 20, and extends between the top rail member 20 and the lower rail member 30 as illustrated, the lower rail member 30 being connected to the lower end of the ladder and slat structure 40. In FIG. 1, the Venetian blind assembly 10 is shown in a fully lowered condition, and is mounted to a window shroud 12 of the type commonly used to frame a window in a recreational camper or van, for example. In FIG. 2, the blind assembly 10 is shown in a partially raised condition wherein the bottom rail member 30 has been raised toward the top rail member 20 wherein the lower portion of the ladder and slat structure 40 is collapsed and stored on the bottom rail member 30.

With reference to FIG. 1, the window shroud 12 includes a rectangular face trim portion 13 from the inner periphery of which extends in perpendicular fashion a left sidewall 14 an opposed right sidewall 16, a sill 18, and a top wall 19. The blind assembly 10 is sized to fit within the recess defined by the rectangular face trim 13, the related sidewalls 14, 16, the sill 18, and the top wall 19. At the top ends of the sidewalls 14, 16, and at the bottom ends thereof, there are provided circular apertures for receiving cylindrical mounting studs carried on the ends of the top rail member 20 and the bottom rail member 30 as will now be discussed.

As shown most clearly in FIG. 2, the top rail member 20 is provided at its right end, as viewed in FIG. 2, with a top rail end cap 50 having a cap portion **50*a* and a fixed stud portion 50*b*. In similar fashion, the left end of the top rail member 20 is provided with a top rail end cap 52 having a cap portion 52*a* and a movable stud portion 52*b*. The top rail end caps 50, 52 are press fitted over the ends of a rolled metal head channel 21 which forms the major structural portion of the top rail member 20. The top rail end cap 50 is formed, for example, by injection molding of plastic material wherein the cap portion 50*a* and the fixed stud portion 50*b*** constitute an integral piece.

Figure 3:
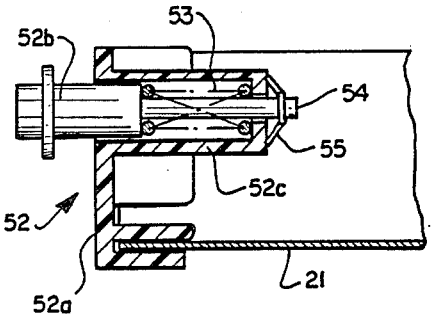
FIG. 3 is a cross-section view of a spring loaded stud for mounting the blind assembly to the associating window shroud illustrated in FIG. 1.

With reference to FIG. 3, a cross-section view of the top rail end cap 52 is illustrated. The end cap 52 includes the cap portion **52*a*, also formed from injection molded plastic material, which is fixed to the left end of the head channel 21 (see FIG. 2). The cap 52*a* includes a cylindrical blind bore or recess portion 52*c* with a diameter slightly larger than the diameter of the movable stud portion 52*b* which can also be formed of injection molded plastic. The movable stud portion 52*b* provided at its rightward end, as viewed in FIG. 3, with an elongated stud guide or pin 54 that is received at its distal end through an aperture in the bottom of the recess portion 52*c*. The stud guide 54 extends through a helical compression spring 53 positioned between the bottom wall of the recess portion 52*c* and the rightward or inner end of the movable stud portion 52*b* as illustrated. The rightward end of the stud guide 54 has fixed thereon a stud retainer clip 55 of a conventional type that holds the movable stud portion 52*b* in its position as illustrated in FIG. 3. It can be seen, that the movable stud portion 52*b* is biased by the spring 53 to maintain its outwardly projecting position from the cap portion 52*a*. It can also be seen that the movable stud portion 52*b* can be pushed inwardly into the recess portion 52*c* and temporarily stored therein, with spring 53** loaded or compressed, until released to resume its normally outwardly projecting position.

It is to be noted, with further reference to FIGS. 1–3, that the stud portions **50*b*, 52*b*, functioning as pivot points, are eccentrically offset relative to the longitudinal axis of the top rail member 20, i.e. the stud portions 50*b*, 50*c* are located above the center of the ends of the rail. The rail member 20 will tend not to rotate or rock on its longitudinal axis, but rather will tend to maintain its illustrated position even when the slats of the blinds are tilted as will be subsequently discussed. This is due to the fact that the pivot axis of rotation of the rail member 20 is above the center of gravity of the rail member 20** so that, in effect, the rail is gravity biased at one rotational position as will be apparent to those skilled in the art.

With further reference to FIG. 2, the bottom rail member 30 has fixed to its right end a bottom rail end cap 60 having a cap portion **60*a* and fixed stud portion 60*b*, the cap 60 being formed as an integral piece of injection molded plastic as is the earlier discussed top end cap 50. At the leftward end of the bottom rail member 30, a bottom rail end cap 62 is provided and has a cap portion 62*a*** and a movable spring biased stud portion 62*b*. In a manner similar to that discussed with regard to the top rail end cap 52, the movable stud portion 62*b* of the cap 62 can be pressed inwardly against a compression spring and temporarily stored within a cylindrical recess portion of the cap portion 62*a* until released where it assumes its normal, spring biased, outward position as illustrated in FIG. 2. As noted earlier with regard to end caps 50, 52 and 60, the cap portion 62*a* and the stud portion 62*b* are preferably composed of injection molded plastic material.

With further reference to FIG. 1, the top rail member 20 and the bottom rail member 30 are sized in length to be slightly less than the distance between the sidewalls 14, 16 of the window shroud 12. As noted earlier, the upper and lower ends of the sidewalls 14, 16 are provided with apertures having a diameter slightly larger than the diameters of the fixed and movable stud portions 50*b*, 52*b*, 60*b*, 62*b* of the end caps 50, 52, 60, 62. To mount the Venetian blind assembly 10 within the shroud as illustrated in FIG. 1, the fixed stud portion 50*b* is inserted into the upper right aperture provided by the sidewall 16. The movable stud 52*b* is pressed inwardly to its stored position wherein the left end of the top rail member 20 can be swung into its position as illustrated in FIG. 1. Upon proper alignment, the spring biased movable stud portion 52*b* will snap into the aperture provided by the window shroud 12 at the upper end of the left sidewall 14.

With only the top rail member 20 mounted in position as illustrated in FIG. 1, the bottom rail member 30 is free to swing outwardly from the shroud 12 and can be raised toward or lowered away from the top rail member 20 by use of lift cords as will be subsequently discussed. With the blind 10 fully lowered, the bottom rail member 30 can be fixed in position adjacent to the sill 18 of the shroud 12 by inserting into the lower right hand corner aperture provided by the sidewall 16 the fixed stud portion 60*b* of the end cap 60 (see FIG. 1). With the stud portion 62*b* of the cap 62 (see FIG. 2) pressed inwardly to its storage portion, the left end of the bottom rail member 30 is swung into position until the movable spring biased stud portion 62*b* aligns itself with the aperture at the lower end of the sidewall 14 wherein it will snap into the aperture so as to lock the bottom rail member 30 in position relative to the top rail member 20.

When used in connection with a window assembly in a moving vehicle such as a recreational van, as illustrated by FIG. 1, or where the blind assembly 10 is to be inclined from a vertical plane for use with for example a skylight, the bottom rail member 30 is normally locked into position as illustrated in FIG. 1. It is only released to allow access to the underlying window for cleaning purposes, or when it is desired to raise the blind for unobsructed viewing through the associated window wherein the bottom rail member 30 is moved toward the top rail member as illustrated in FIG. 2.

The collapsible ladder and slat structure 40 of the blind includes a right side ladder 44 and a left side ladder 46 as shown in FIG. 1. The right side ladder 44 includes a plurality of multi-strand rungs or crosspieces 44*a* vertically equidistantly spaced from each other and extending between a front sidepiece 44*b* and a rear sidepiece 44*c*, the sidepieces 44*b*, 44*c* being parallel to each other and vertically extending between the top rail member 20 and the bottom rail member 30 as illustrated. In similar fashion, the left side ladder 46 includes a plurality of multi-strand rungs or crosspieces 46*a* extending between a front sidepiece 46*b* of the ladder and a rear sidepiece 46*c* as illustrated. The ladders 44, 46, or tapes as they are commonly referred to, are typically formed from flexible multi-stranded cotton or nylon cords and bare the weight of a plurality of rolled aluminum slats 48 which rests on the crosspieces 44*a*, 46*a* of the ladders 44, 46. It can also be seen that the slats 48 are positioned between the respective pairs of sidepieces 44*b*, 44*c* and 44*b*, 46*c* so that the slats can be tilted by moving the sidepieces 44*b*, 44*c* and 46*b*, 46*c* in opposed vertical directions relative to each other wherein the blinds can be opened and closed as is well known in the art. The lower ends of the ladders 44, 46 are connected to the bottom rail member 30 in a manner to be subsequently illustrated while the top ends of the ladders 44, 46 are connected to a conventional slat tilting mechanism 26 (see FIG. 2) of the worm gear type contained within top rail member 20.

With particular reference to FIG. 2, the tilting mechanism to which the top ends of the ladders 44, 46 are connected includes an elongated D-rod 22 rotatably supported by a pair of D-rod support bracket and tape rollers 24. The D-rod 22 can be rotated on its longitudinal axis by a conventional tilt gear mechanism 26 which is operated by the blind user using a baton 27 that can be twisted or rotated to effect concurrent tilting of the slats 48 as discussed earlier.

With reference to FIG. 1, the blind assembly 10 is also provided with a pair of lift cords, namely a right side lift cord 45 and a left side lift cord 47, the lift cords extending downwardly in horizontally spaced relationship between the sidepieces 44*b*, 44*c* and 46*b*, 46*c* of the ladders 44, 46 through a plurality of apertures in the slats, in the preferred form of narrow transverse slots 49 (see FIG. 2) wherein the lift cords 45, 47 are engagable with the slats 48 as they move in a horizontal plane relative to the vertical lift cords 45, 47.

As illustrated in FIG. 1, the lower ends of the lift cords are received into the interior of the bottom rail member 30 via a right lift cord guide 45*a* and a left lift cord guide 47*a* and are retained therein by a spring means in the preferred form of a helical compression spring 70 (illustrated in phantom). The end of the lift cord 47 is connected to one end i.e. the left end of the spring 70 as viewed in FIG. 1 while the end of the right side lift cord 45 is connected to the right end of the spring 70 as illustrated.

The lift cords extend upwardly into the interior volume of the head channel 21 and then extend rightwardly over conventional guide pulleys through a lift cord locking mechanism 28 (see FIG. 2) of a conventional type, the upper ends of the lift cords extending through the locking mechanism to a pendant tassel 29 which can be gripped by the user wherein the lift cord portions hanging down from the lock 28 can be manipulated. With the bottom rail member 30 free to move upwardly toward the top rail member as illustrated in FIG. 2, the tension spring 70 will be unloaded, that is it will be in an unexpanded condition (see FIG. 2) wherein the user, in pulling downwardly on the tassel end of the lift cords, will cause the lift cords to raise the bottom rail member 30 upwardly to raise the blind thus permitting access to the underlying window for pusposes of cleaning or for unobstructed viewing.

Figure 4:
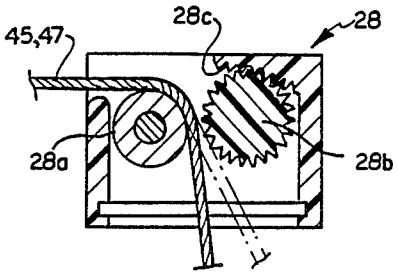
FIG. 4 is a cross-section view of a conventional releasable lift cord lock for use in manipulating lift cords to raise and lower the blind.

As is well known in the art, and with particular reference to FIG. 4, the lift cord lock 28 includes a guide roller 28*a*, a gearlike movable locking roller 28*b*, and a toothed rack 28*c* which engages with the lock roller 28*b* when the lift cords 45, 47 engage the lock roller **28*b* and force it upwardly (see phantom position of cords 45, 47) to engage the rack 28*c* wherein the cords are in effect pinched and locked in position between the rollers 28*a*, 28*b* as they retract slightly due to the weight of the bottom rail member 30 and any slats 48 stored thereon. By manipulation of the tassel 29*a*, and thus the pendant ends of the lift cords hanging down from the lock 28 the user can control the position of the bottom rail member 30 when not locked in position as shown in FIG. 2. Thus, the blind can be raised using the lift cords 45, 46 and can be locked in the raised position (FIG. 2) or the blind can be lowered by gravity to a fully lowered position (FIG. 1). As noted earlier, the helical tension spring 70 is of sufficient strength so that it is unloaded i.e. it is not in an expanded condition during normal raising and lower of the blind 10**.

When the bottom rail member 30 is locked in position as illustrated in FIG. 1, the tassel 29 can be gripped by the user wherein the lower portions of the lift cords stored in the bottom rail member 30 are partially pulled from within the bottom rail member 30 wherein the tension spring 70 is loaded or expanded (as shown in FIG. 1) so as to apply a tensioning force on the lift cords 45, 47. The now tensioned lift cords are locked in place by using the earlier lock 28. It can be seen that the tension lift cords extending through the slots 49 (see FIG. 2) of the slats 48 will maintain and stabilize the position of the slats, their movement being limited to the degree permitted by the length and width of the slots 49. Therefore, when used in a moving vehicle, the slats 48 of the blind assembly 10, held in position by the tensioned lift cords 45, 47, will be limited in their movement so that they will not bounce and knock against the adjacent window. In a similar manner, where the blind assembly 10 is installed on a window frame inclined from a vertical plane such a skylight, the tensioned lift cords 45, 47 will preclude the slats 48 from sagging as a group away from the vertically inclined window.

It can be seen that the lock 28 serves two functions, namely to maintain the bottom rail member at a raised position, or to maintain tension on the lift cords when the bottom rail member is locked in position.

It can also be seen that the user can control the amount of tension on the lift cords 45, 47 as determined by the length of the lower lift cord portions pulled from within the bottom rail member 30. Thus, a variable amount of tension can be provided by the user wherein only the required amount of tension needed to stabilize the blind in a particular installation environment is provided.

To raise the blind, the lift cords are manipulated to release the lock 28 so as to allow them to retract back into the bottom rail member 30 wherein the spring 70 returns to its unloaded unexpanded condition as shown in FIG. 2. The bottom rail can now be snapped out of its position as illustrated in FIG. 1 and can be raised using the lift cords to permit access to the underlying window.

Figure 5:
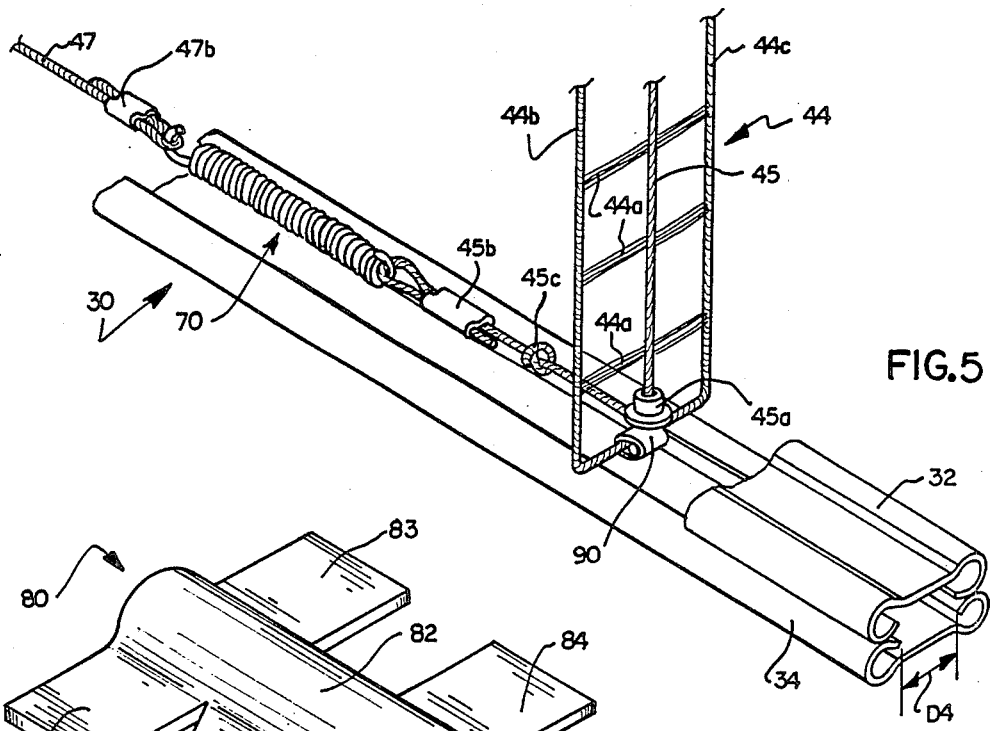
FIG. 5 is a perspective view of a portion of the bottom rail member of the blind assembly with portions cut away and blind elements deleted.

With reference to FIG. 5, the end portion of the bottom rail member 30 containing the spring 70 is more clearly illustrated. It can be seen that the bottom rail member 30 includes an elongated upper channel member 32 constituting a top half of the bottom rail member 30 and an elongated lower channel member 34 constituting a bottom half of the bottom rail member 30. The channel members 32, 34 are formed of rolled sheet metal, e.g. aluminum, of a suitable gauge, and are generally identical to each other, the lower channel member 34 being inverted relative to the top channel member 32 as illustrated. The channel members 32, 34 are held in position relative to each other in a manner to be subsequently discussed. With further reference to FIG. 5, it can be seen that the bottom rail member 30 has a hollow interior which contains the helical tension spring 70 (shown in an unloaded or unexpanded condition). As viewed in FIG. 5, it can be seen that the lower end of the right lift cord 45 is fed through the annular right lift cord guide **45*a*, and then extends leftwardly to the rightward end of the spring 70 which is is looped through to connect to the tension spring 70. A lift cord loop retainer clip 45*b* is crimped on the doubled back end of the lift cord 45 to maintain the loop extending through the hook end of the spring 70 as illustrated. To preclude over expansion of the spring 70, and to also limit the maximum amount of tension on the lift cord 45, a knot 45*c* is tied at a predetermined location on that portion of the lift cord contained within the rail member 30, the knot 45*c* functioning to provide an increased diameter portion of the lift cord 45 which cannot be pulled through the lift cord guide 45*a*. In a similar fashion, the end of the left lift cord 47 is looped through the hook end on the left end of the spring 70 the loop being maintained by an associated retaining clip 47*b*, a knot (not illustrated) being tied in that portion of the lift cord 47 contained within the bottom rail member 30 at a position spaced from the left lift cord guide 47*a* (see FIG. 1) at a corresponding position generally identical to the position of the knot 45*c* relative to its lift cord guide 45*a*. Thus, it can be seen that the knots provided on the lift cords act as stops to limit the amount of cord pulled from within the bottom rail member 30 which in turn limits the amount of maximum tension on the lift cord 45, 47, and also precludes over expansion of the spring 70. It can also be seen that the spring, since it is connected between the lower ends of the lift cords 45, 47**, functions to equalize the tension applied to the lift cords when pulled from within the bottom rail member as discussed earlier.

FIG. 5 also illustrates a preferred means for connecting the bottom ends of the ladders 44, 46 to the bottom rail member 30. While in FIG. 5, only the connection of the bottom end of the right ladder 44 is illustrated, it is to be understood that the connection of the bottom end of the left ladder 46 to the rail member 30 would be generally identical.

The bottom ends of the ladder sidepieces **44*b*, 44*c* extend between the upper channel member 32 and the lower channel member 34 as illustrated. An annular cliplike member 90, made from deformable material e.g. brass, receives through one of its ends the lower end of the rear sidepiece 44*c*, while the other end of the annular member 30 receives the lower end of the front sidepiece 44*b* as illustrated. It can be seen that the annular member 90 is cylindrical and extends transverse to the length of the bottom rail member 30 wherein, in effect the, interconnected lower ends of the sidepieces 44*c*, 44*b* form a bottom rung upon which the upper channel member 32 of the bottom rail member 30 rests. In practice, the lower ends of the sidepieces 44*b*, 44*c* are progressively pulled through opposite ends of the annular member 90 to accurately set the length of the ladder 44, i.e. the length of the ladder between the bottom rail member 30 and the top rail member 20, wherein, when such length is accruately established, the annular member 90 is crimped or deformed to lock the end pieces in position within it. Such a technique allows for accurate setting of the length of the blind 10**, and also facilitates easy assembly thereof.

Figure 6:
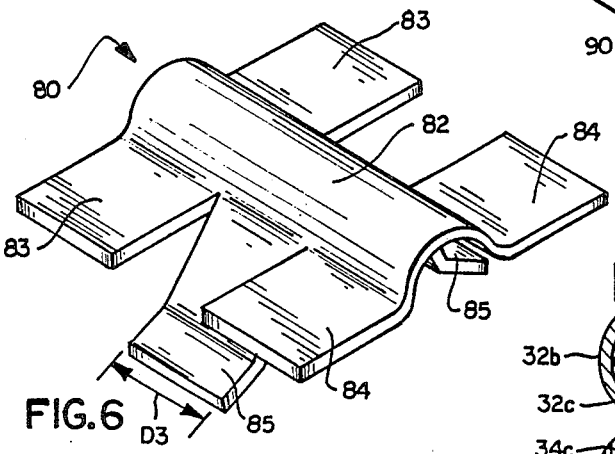
FIG. 6 is a perspective view of a spring clip used to interconnect upper and lower halves of the bottom rail member.
Figure 7:
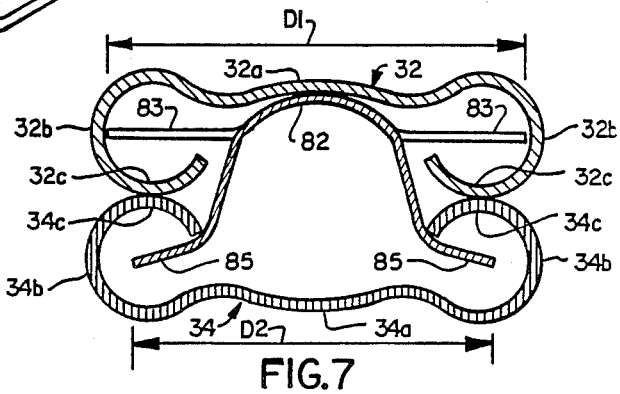
FIG. 7 is a cross-section view of the spring clip of FIG. 6 mounted within the bottom rail member of the blind assembly.

A better understanding of the structure of the bottom rail member 30 can be had by reference to FIGS. 6 and 7 in addition to earlier discussed FIG. 5. With reference to FIG. 6, a spring clip means in a preferred form of a metal clip 80 stamped from a flat piece of spring metal material is illustrated. The clip 80 includes an elongated protuberance 82 having an arcuate cross-section as illustrated. At one end of the protuberance 82, a first pair of fixed projections or tabs 83 is provided while at the other end thereof a second pair of fixed projections or tabs 84 are provided. Extending outwardly in opposed directions and downwardly from the middle of the protuberance 82 is a pair of resilient projections or tabs 85 that are below the plane in which the tab pairs 83, 84 lie as illustrated in FIG. 6. In the blind 10 illustrated, a single spring clip 80, positioned lengthwise in the center of the lower rail member 30, is used to interconnect the upper and lower channel members 32, 34, while the ends of the rail portions 32, 34 are interconnected and held together by the earlier discussed end caps 60, 62 which fit over the juxtaposed ends of the rail portions 32, 34.

FIG. 7 illustrates a cross-section of the clip in position at the center of the bottom rail member 30. The upper channel member 32 has a web **32*a*, a pair of opposed side flanges 32*b* extending in a common direction from the web 32*a*, and a pair of lips 32*c* extending toward each other from the distal ends of the side flanges 32*b* as illustrated. In a similar fashion, the lower channel member 34 of the bottom rail member 30 includes a web 34*a* and a pair of side flanges 34*b*, extending in a common direction from the web 34*a*, and a pair of lips 34*c* extending toward each other from the distal ends of the side flanges 34*b*. It can be seen that the upper and lower channel members 32, 34 are inverted relative to each other so that their lips 32*c*, 34*c* are in contiguous relationship. In constructing the bottom rail member 30, the clip 80 with its pairs of tabs 83, 84 is slid into one end of the upper half 32 and then slid lengthwise to the center of the upper channel member 32. With reference to FIG. 7, the distance between the ends and the projections 83, 84, designated as distance D1, is slightly less than the maximum distance between the inside wall of the side flanges 32*b* which are curved as illustrated, wherein the clip 80 is held or trapped in position within the upper channel member 32 of the bottom rail member 30. Thus, the springlike pair of resilient tabs 85 project downwardly below the lips 32*c* of the upper half 32. As illustrated in FIG. 6, the width distance D3 of each of the springlike tabs 85 is slightly less than the distance D4 (see FIG. 5) between the ends of the lips 34*c* of the lower channel member 34 of the bottom rail member 30. To assemble the lower channel member 34 the upper channel member 32, the lower member 34 is held at right angles to the upper member 32, the clip portions 85 are then inserted into the space between the lips 34*c*. The lower member 34 is then rotated 90 degrees wherein the tabs 85 (FIG. 7) initially move inwardly toward each other, and then snap outwardly to lock the rail lower half 34 in position as illustrated in FIG. 7. It can be seen that the resilient projections 85 extend into the space between the web 34*a* and the lips 34*c* in a manner similar to the projection of the tabs 83, 84 into the space between the lips 32*c* and the web 32*a*. When the clip 80 is installed within the rail member 30, the distance D2 (FIG. 7) between the ends of the tablike projections 85 is slightly less than the corresponding distance when the clip is not installed in the rail. Hence, the tabs 85 are, by design, tensioned so as to provide a spring biasing force tending to move the lower half 34 and the upper half 32 of the bottom rail 30 together. It will also be recognized, as discussed earlier with regard to FIGS. 1 and 2, that the ends of the rails are now held in position relative to each other by the end caps 60, 62 to preclude rotation of the lower channel member 34 relative to the upper channel member 32. The illustrated lower rail member 30** provides a strong rail assembly resisting bowing or arcing that might otherwise be caused by the tensioning force placed on the lower rail by the tension lift cords as discussed earlier.

Thus, it can be seen that a Venetian blind assembly is provided wherein the lift cords thereof can be tensioned to a predetermined degree to stabilize the positioning of the associated ladder and slat structure. It can also be seen that the length of the blind can be accurately controlled by use of annular clip members for connecting the lower ends of the ladders to the bottom rail, wherein, if desired, the blind can be made slightly shorter than the distance between the apertures for fixing the lower and upper rail members in position, wherein a small amount of tension can be applied to the ladders to augment the slat stabilizing effect of the tensional lift cords, thus enhancing the stability of the ladder and slat structure. This slight degree of tension, unlike the excess tension often applied in the earlier noted prior art technique, will not deleteriously effect the tilting of the blind slats. It can also be seen that a strong relatively rigid bottom rail member has been provided, the bottom member being easily assembled by use of substantially identical upper and lower halves interconnected by a spring clip.

Finally, it is to be realized that larger blinds having longer bottom rails may require multiple clips for interconnecting the upper and lower halves of the rail, and that more than two pull cords, requiring additional tension springs, and more than two ladders may be required.

Although the preferred embodiment of this invention has been shown and described, it should be understood that various modifications and rearrangements of the parts may be resorted to without departing from the scope of the invention as disclosed and claimed herein.

What is claimed is:

1. A bottom rail member for a Venetian blind assembly having a top rail member, and a collapsible ladder and slat structure interconnecting and extending between the bottom and top rail members, the bottom rail member comprising:

an elongated upper channel member having a web and a pair of side flanges extending in a common direction therefrom, the elongated upper channel member including a pair of lips provided at the distal ends of the side flanges, the lips extending toward each other in spaced relation from the web of the upper channel member;

an elongated lower channel member having a web and a pair of side flanges extending in a common direction therefrom, the elongated lower channel member including a pair of lips provided at the distal ends of the side flanges, the lips extending toward each other in spaced relation from the web of the lower channel member; and spring clip means for connecting the upper and lower channel members together with their pair of lips in contiguous relationship wherein said webs are spaced from each other by the width of the side flanges to provide a hollow rail member containing the clip means wherein the clip means includes portions extending into the spaces between all of said lips and the associated webs of the channel members.

2. A bottom rail member according to claim 1, wherein the said upper channel member, and the lower channel member are substantially identical.

3. A bottom rail member according to claim 1, wherein some of said portions engage at least one of said pairs of lips.

* * * * *